US006380909B1

(12) United States Patent
Wilkinson et al.

(10) Patent No.: US 6,380,909 B1
(45) Date of Patent: Apr. 30, 2002

(54) MULTI-FUNCTIONAL MAST

(76) Inventors: Richard Paul Wilkinson, 41 Eastlands Road, Rugby, Warwickshire (GB), CV21 3RP; Jeremy Joseph Hughes-Hubbold, 43 Marsh Grove, Swindon, Dudley, West Midlands (GB), DY3 4NL ( * ) Notice: Subject to any disclaimer, the term of this patent is extended or adjusted under 35 U.S.C. 154(b) by 0 days.

(21) Appl. No.: 09/315,273

(22) Filed: May 20, 1999

(30) Foreign Application Priority Data

May 21, 1998 (GB) ..... 9810919

(51) Int. Cl.[7] ..... H01Q 1/12

(52) U.S. Cl. ..... 343/890; 343/891; 52/40; 52/736.1

(58) Field of Search ..... 343/874, 875, 343/890, 891, 892, 721, 878; 52/40, 726.4, 736.1; H01Q 1/12

(56) References Cited

U.S. PATENT DOCUMENTS 2,099,671 A * 11/1937 Bairey ..... 343/721
2,420,772 A * 5/1947 Dalton ..... 343/721
4,468,671 A * 8/1984 Ellingson et al. ..... 343/766
5,375,353 A * 12/1994 Hulse ..... 343/721
5,570,546 A * 11/1996 Butterworth et al. ..... 343/890
5,581,958 A * 12/1996 Cote ..... 343/890
5,683,064 A 11/1997 Copeland et al. ..... 248/278.1
5,687,537 A 11/1997 Noble ..... 52/726.3
6,018,325 A * 1/2000 Lundgren ..... 343/890
6,173,537 B1 * 1/2001 Davidsson et al. ..... 343/890

FOREIGN PATENT DOCUMENTS

EP 0 825 313 A1 2/1998

* cited by examiner

*Primary Examiner*—Hoanganh Le
(74) *Attorney, Agent, or Firm*—Harold Marquis; Myers & Associates, Intellectual Property Law P.C.

(57) ABSTRACT

An apparatus for providing a mast suitable for use with closed circuit television equipment comprising a plurality of tubular sections detachably connected together to define a tubular structure with two ends wherein a lower end is fixed to a support and the structure tapers towards its upper end to provide a rigid structure and wherein the apparatus further comprises a support for supporting a camera or the like at an upper portion of the tubular structure. There also comprises a device for supporting a housing in a confined area of a mast and for manipulating the housing out of said confined area which apparatus comprises a flexible joint interconnecting an internal wall of the mast and housing, which flexible joint is adapted to move the housing from a stored position to an extended position.

9 Claims, 15 Drawing Sheets

MULTI-FUNCTIONAL MAST

BACKGROUND OF THE INVENTION

1. Field of the Invention

The present invention relates to a modular mast particularly those incorporating closed circuit television equipment and other like functions.

2. Description of the Related Art

Masts are widely used in many fields to carry equipment required to be mounted in a raised position, for example antennae for telecommunications signals. In recent years closed circuit television equipment has become a useful tool for local authorities and the police for monitoring roads and public places, particularly in urban areas. Commonly, such equipment is mounted to building walls in elevated positions. Where there is no appropriate wall, then a suitable apparatus usually a pole is used to mount such equipment in an elevated position. Known camera mounting apparatus is considered to be unattractive and can be subject to unwanted movement in high winds or if it is tampered with. Further, if the apparatus is damaged, the entire mounting apparatus will need to be replaced.

Further, a common problem experienced by telecommunications industry concerns the siting of mobile telecommunications antennae in urban areas. Commonly, they are positioned on top of buildings, but such positions can cause interference. A further requirement is that these antennas are required to be connected to transceivers or transmitters usually referred to as "base stations" which are bulky. It has generally restricted the siting of the equipment to buildings only.

The present invention and its preferred embodiments seeks to overcome or at least mitigate the problems of the prior art and there is provided a multi-functional mast which mitigates the problems highlighted above.

SUMMARY OF THE INVENTION

Briefly described, in a preferred form, the invention provides an apparatus for providing a rigid mast suitable for use with closed circuit television equipment comprising a plurality of tubular sections detachably connected together to define a tubular structure with two ends wherein a lower end is fixed to support means and the structure tapers towards its upper end to provide a rigid structure and wherein the apparatus further comprises support means for supporting a camera or the like at an upper portion of the tubular structure.

The advantage of the apparatus of the present invention is that the modular nature of the apparatus allows replacement of a damaged section only, thereby providing cost savings. Further, the structure is more rigid than known mounting apparatus and, advantageously, is a more pleasing sight. The structure can retain a base station within a tubular section, thereby enabling antennae to be positioned much closer to street level and the users.

According to an optional feature of this aspect of the invention, the mast is multi-functional According to another optional feature, there further comprises a light source positioned in a lower tubular section, means to transmit light from the light source to the upper end of said structure thereby to be emitted from said upper end and control means to control the light emission. Preferably the upper end is defined by a pyramidal section of transparent or translucent material adapted to receive and emit light from the light source.

According to a further optional feature of this aspect of the invention further comprising an antenna to receive an incident signal and means to transmit the signal between the antenna and a base station positioned in a lower tubular section of the mast.

According to yet another optional feature of this aspect of the invention, the apparatus further comprises hinge means extending from a side portion of the mast and a sign hingably connected to said hinge means.

Optionally, one of said tubular sections comprises an aperture for receiving the display face of a visual display unit of a computer.

According to another optional feature of the invention there further comprises a display panel struck from an external face of the apparatus including a frame and glazed panel for receiving and retaining advertising indicia or the like.

Another aspect of the invention provides a device for supporting a housing in a confined area of a mast and for manipulating said housing into an out of said confined area which apparatus comprises flexible joint means interconnecting wall of the mast and said housing, which flexible joint means is adapted to be moved in a substantially horizontal plane. Preferably, the flexible joint means comprises a chain including individual links interconnected one to next by a pin and retention means.

The advantage of the device of the preceding paragraph is that bulky equipment can be stored in a compact manner, yet still remaining readily accessible if the equipment requires maintenance.

In another optional feature of the second aspect of the invention, the flexible joint means is connected to the housing by slidable means adapted to move the flexible joint means relative the housing. Optionally, the housing is pivotally mounted to the flexible joint means.

According to another optional feature of the second aspect of the invention, the housing is adapted to house a telecommunications base station.

These and other objects, features, and advantages of the present invention will become more apparent upon reading the following specification in conjunction with the accompanying drawing figures.

DESCRIPTION OF THE PREFERRED EMBODIMENTS

Figure 1:
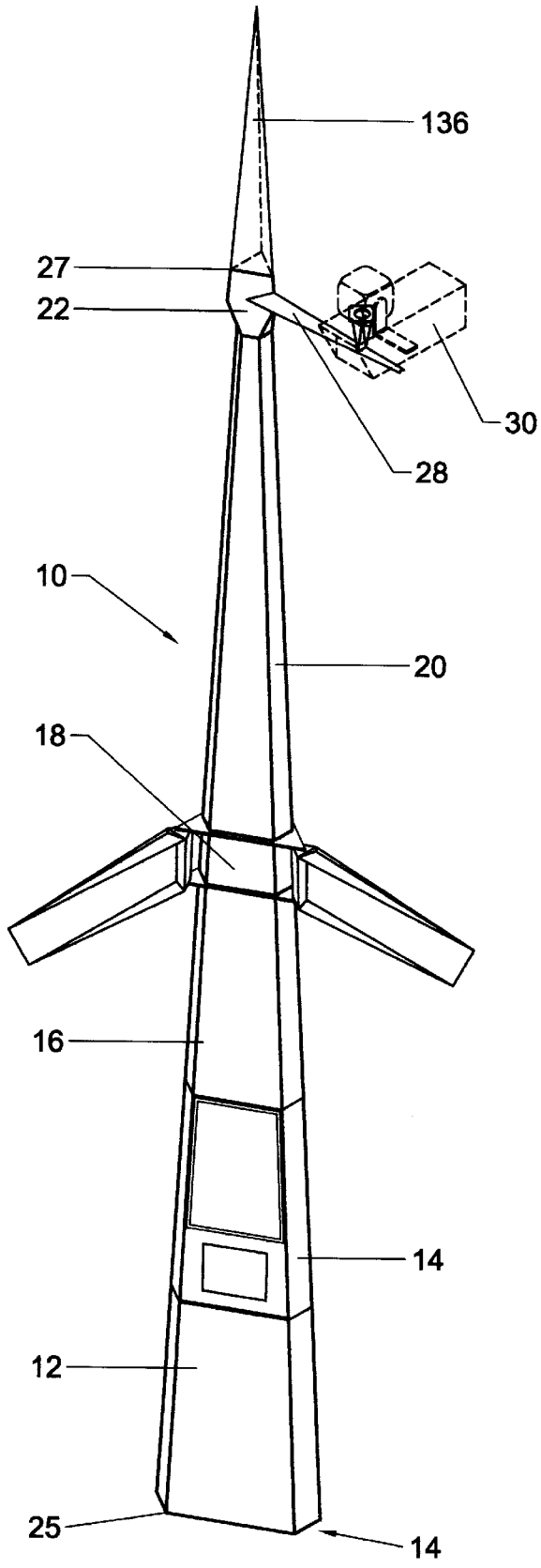
FIG. 1 illustrates a perspective view of multi-function mast of the invention.
Figure 2:
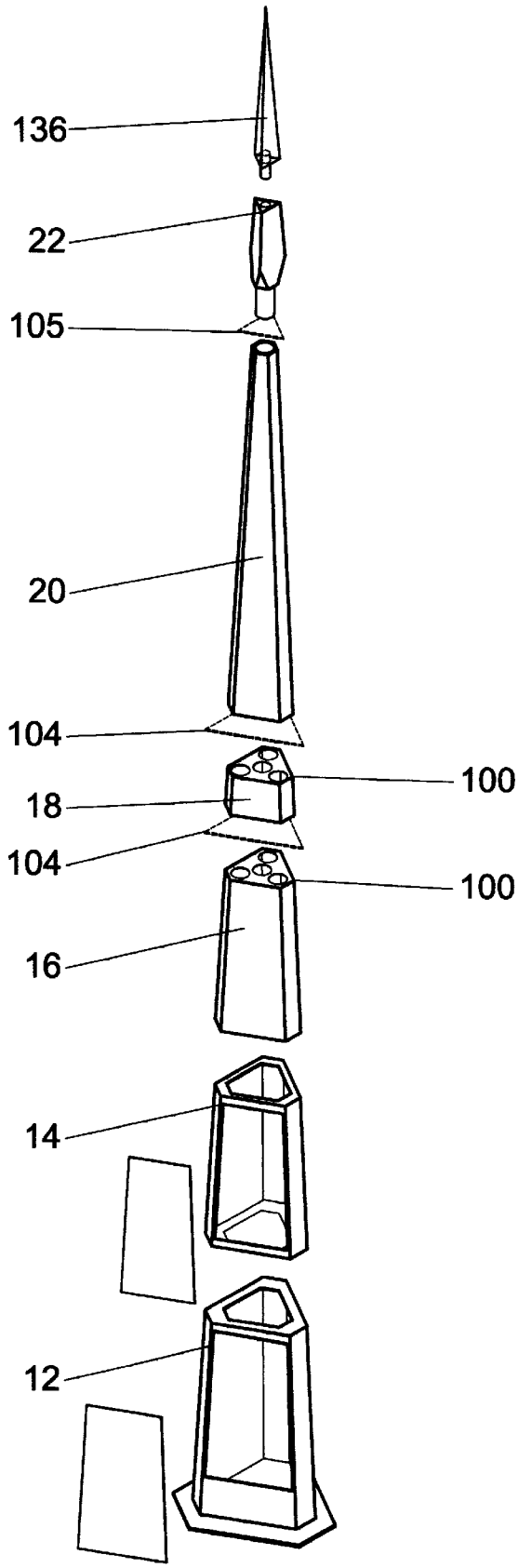
FIG. 2 is an exploded view of the modular form of the mast illustrated in FIG. 1.

Turning to the drawings and in particular FIGS. 1 and 2 there comprises an apparatus 10 for providing a mast suitable for the use with closed circuit television equipment. The apparatus 10 comprises a plurality of tubular sections: a base module 12, a lower module 14, an intermediate module 16, a feature module 18, an upper module 20, and a mast head 22 detachably connected to define a tubular structure 24 with two ends 25, 27 when a lower end is fixed to support means (not shown). The structure tapers towards its upper end to provide a rigid structure. The apparatus 10 further comprises support means 28 for supporting a camera or the like 30 at an upper end portion of the tubular structure 24.

The mast is preferably fabricated from sheet steel or other suitable sheet material. In this embodiment, the mast is formed in polished stainless steel. The construction of each tubular section is preferably achieved by bending and welding together sections of steel into a tubular configuration, which in this embodiment comprises six-sided profile comprising three longer sides inter-spaced by three shorter sides. It is envisaged that other known fabrication methods can be employed without departing from the scope of protection. Likewise, it is considered other shapes can be fabricated without departing from the scope of the invention.

Figure 3:
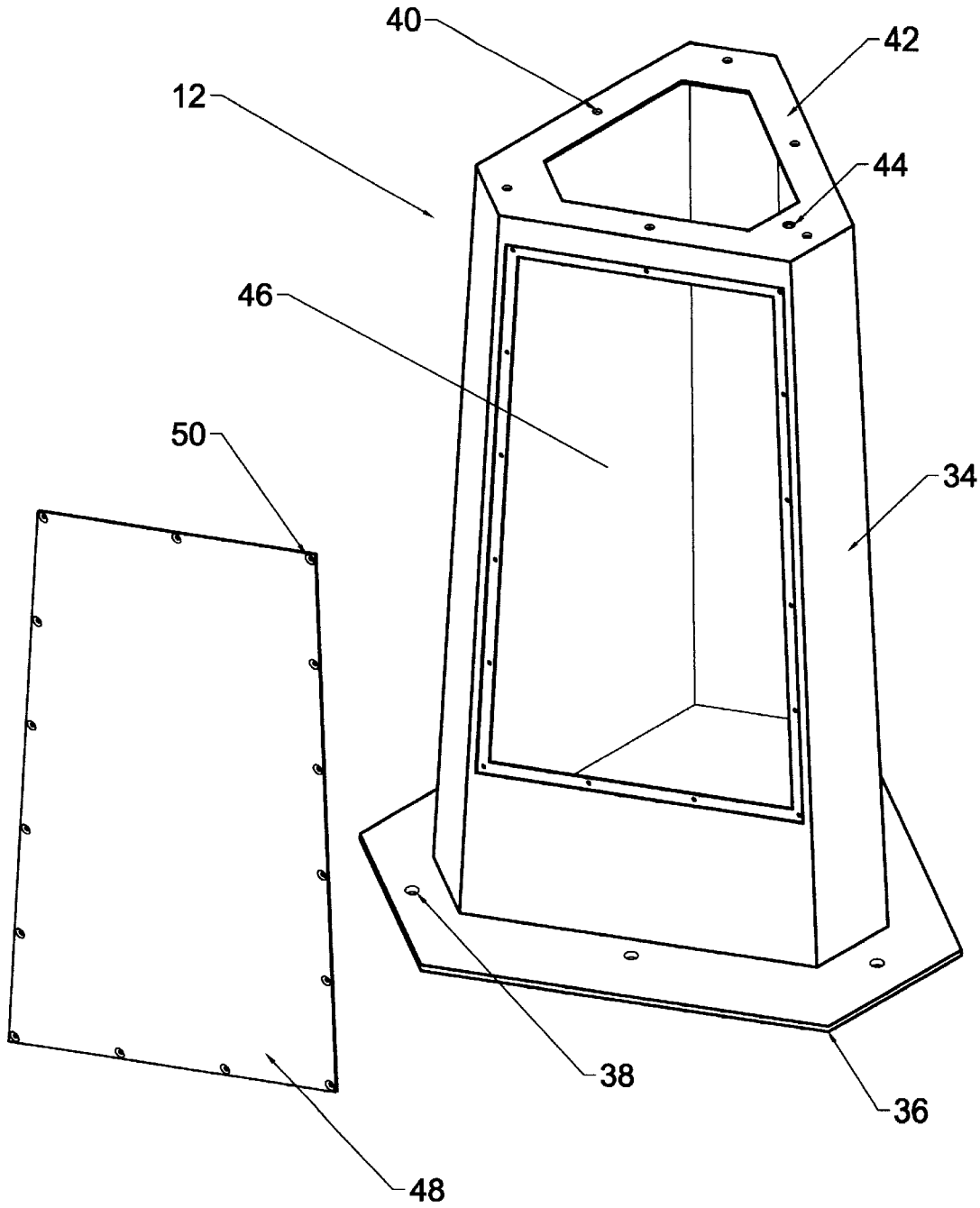
FIG. 3 illustrates the base module shown in FIG. 2.

Turning to the construction of the lowest or base module illustrated in FIG. 3, there is shown tubular section 12 including a six sided body 34 which tapers inwardly towards the top of the module. A flange 36 is provided at the base of the module with a number of apertures 38 to receive bolts for securing the base module 12 to the support means (not shown). Support means is preferably constructed from concrete or other suitable materials to provide a foundation situated ideally at ground level.

The upper end 40 of the base module includes a bulk head 42 including apertures 44 to receive bolts connecting the base module with the lower module 14 hereinafter described.

In this embodiment, the base module includes an access area 46 formed on one side of the module, the access area including a frame and recess to receive and retain an access cover 48. The access cover 48 is connected to the module by suitable fixing means, for example anti-tamper screws.

The base module 12 and, in this embodiment the lower module 14, provides an area within the tubular sections for accommodation of equipment to control the various functions of the mast, described in greater detail below.

Figure 4:
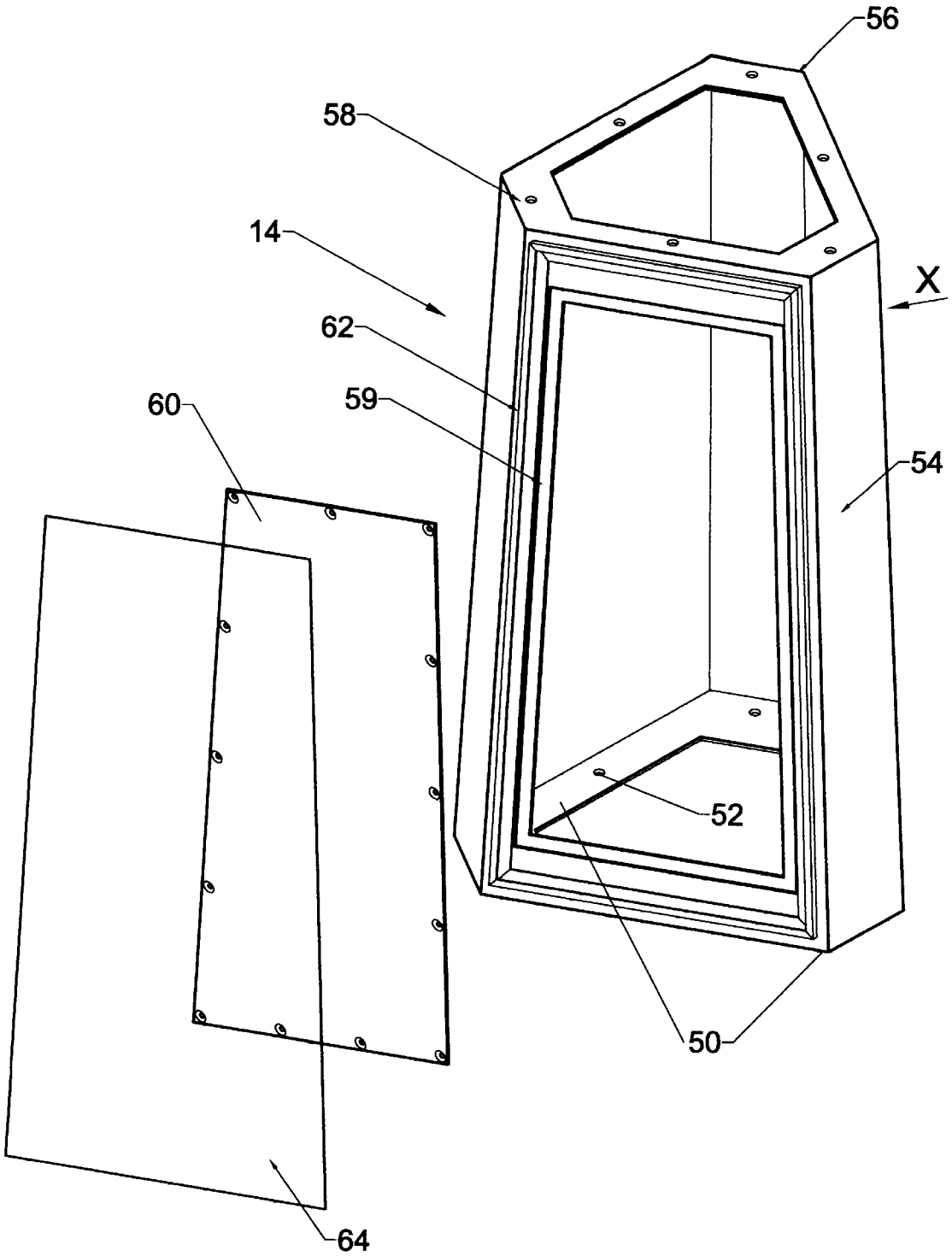
FIGS. 4 and 5 are perspective views of the lower module illustrated in FIG. 2.
Figure 5:
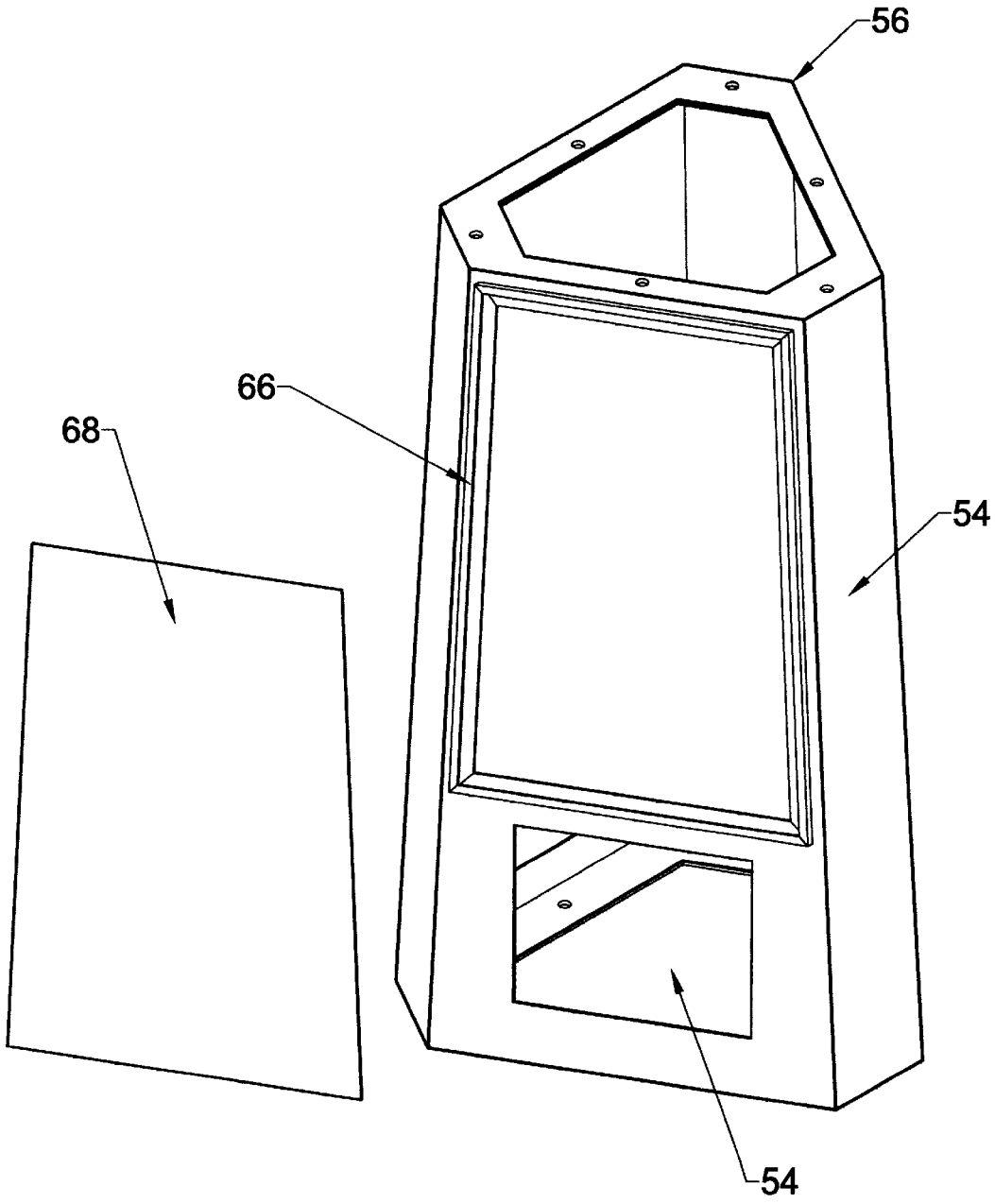

The lower module 14, illustrated in FIGS. 4 and 5, is substantially similar in shape to the base module and includes a bottom bulk head 50 corresponding in size and shape to the top bulk head 42 of the base module. The bottom bulk head 50 includes apertures 52 to receive bolts or other suitable connecting means to connect the base module 12 and the lower module 14. The body 54 of the lower module tapers inwardly towards the top of this module and also includes a top bulk head 56 with apertures 58 for receiving known fastening or connecting means to be interconnected to the middle module, as shown in FIG. 2.

Likewise, the lower module 14 is provided with an access aperture 59 adapted to receive and retain an access cover 60 connected to the body by suitable fixing means, for example anti-tamper fixing screws. An outer frame 62 is positioned adjacent to and surrounding the access cover frame for receiving a glazed panel 64 behind which advertising matter, indicia or the like can be located, thereby to conceal the access cover.

FIG. 5 illustrates a view of the lower module viewed from X and shows an optional second frame 66 for supporting a glazed panel 68 to receive a second advertising display. The mast may comprise one or more advertising panels similar to the types hereinbefore described. The lower module may further comprise an aperture 70 for receiving and retaining a touch sensitive information screen that is positioned at a suitable height for a user.

Figure 14:
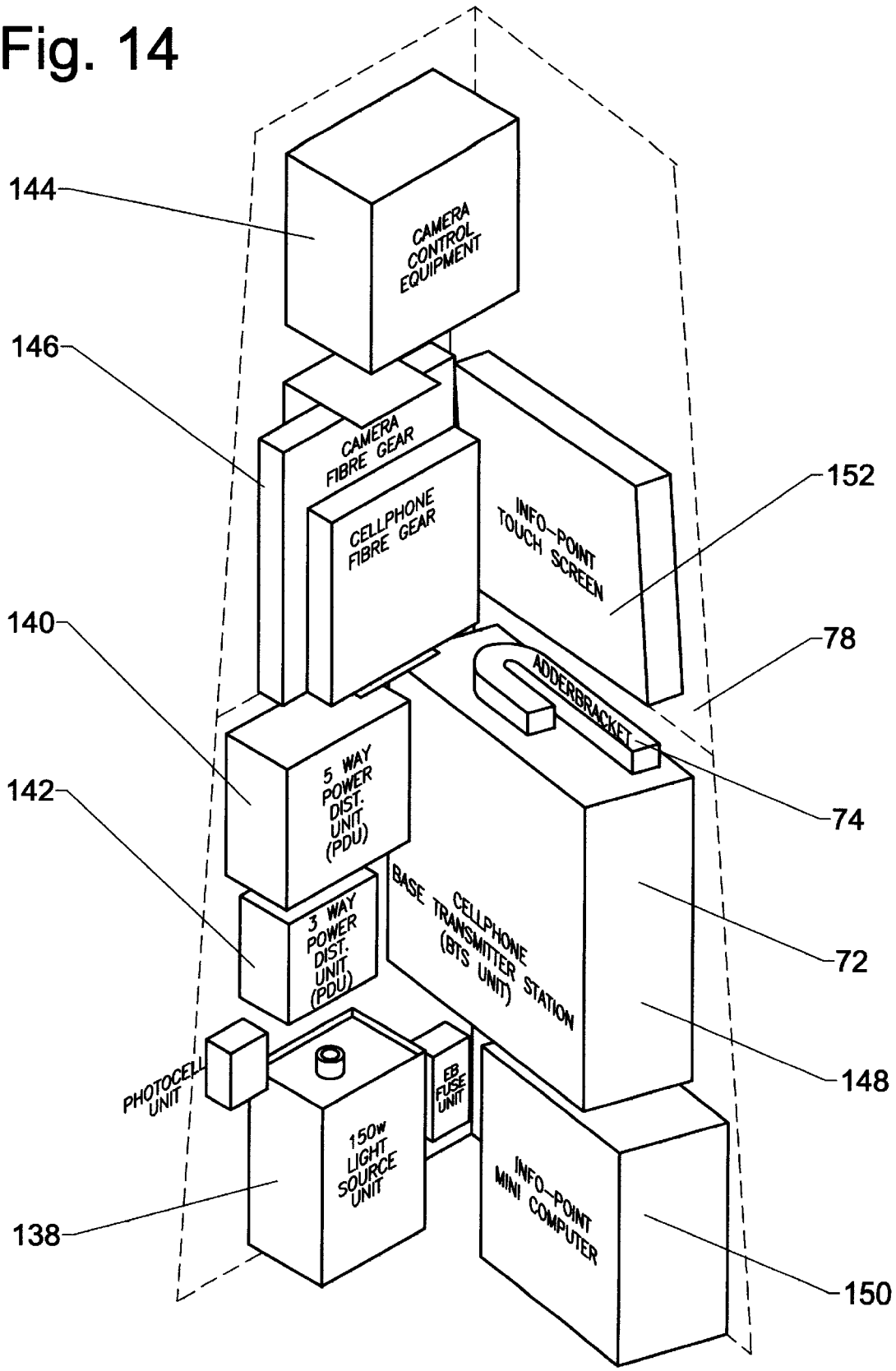
FIG. 14 illustrates the storage facility within the mast of FIG. 1.

As shown in FIG. 14, one or more items of equipment, for example a base transmitter station, can be housed in a movable housing 72 indirectly connected to an internal wall of the base module 12 by a device 74 for supporting a housing 72 in the confined area of it. The term "base station" in this specification means any one or more of the following: a relay station, transceiver station, transmitting station, or monitoring station and in this embodiment, relates to mobile telecommunications technology. The base station housing 72 can be required to be manipulated out of the confined area for maintenance purposes. In order to manipulate the base station the device 74 comprises flexible joint means 76 (FIG. 6) interconnecting a wall 78 of the mast and the housing 72, which flexible joint means 76 is adapted to move the housing from a stowed position to an extended position.

Figure 6:
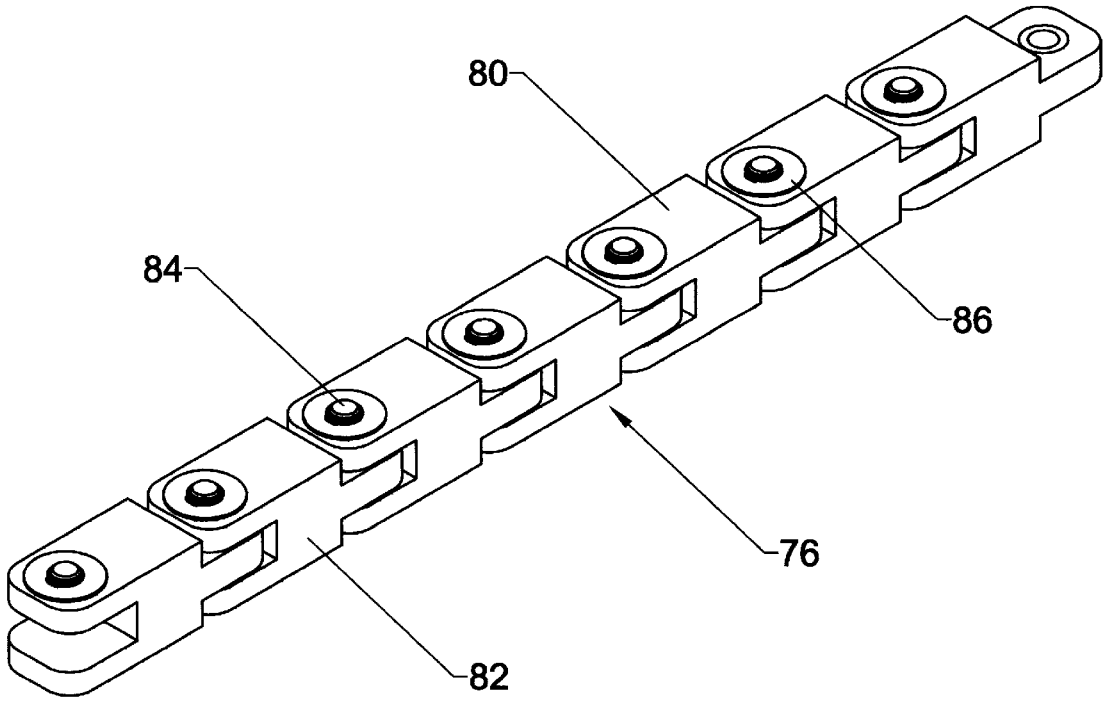
FIGS. 6 and 7 show the device for moving a housing from a stowed position to an extended position of another aspect of the invention.
Figure 7:
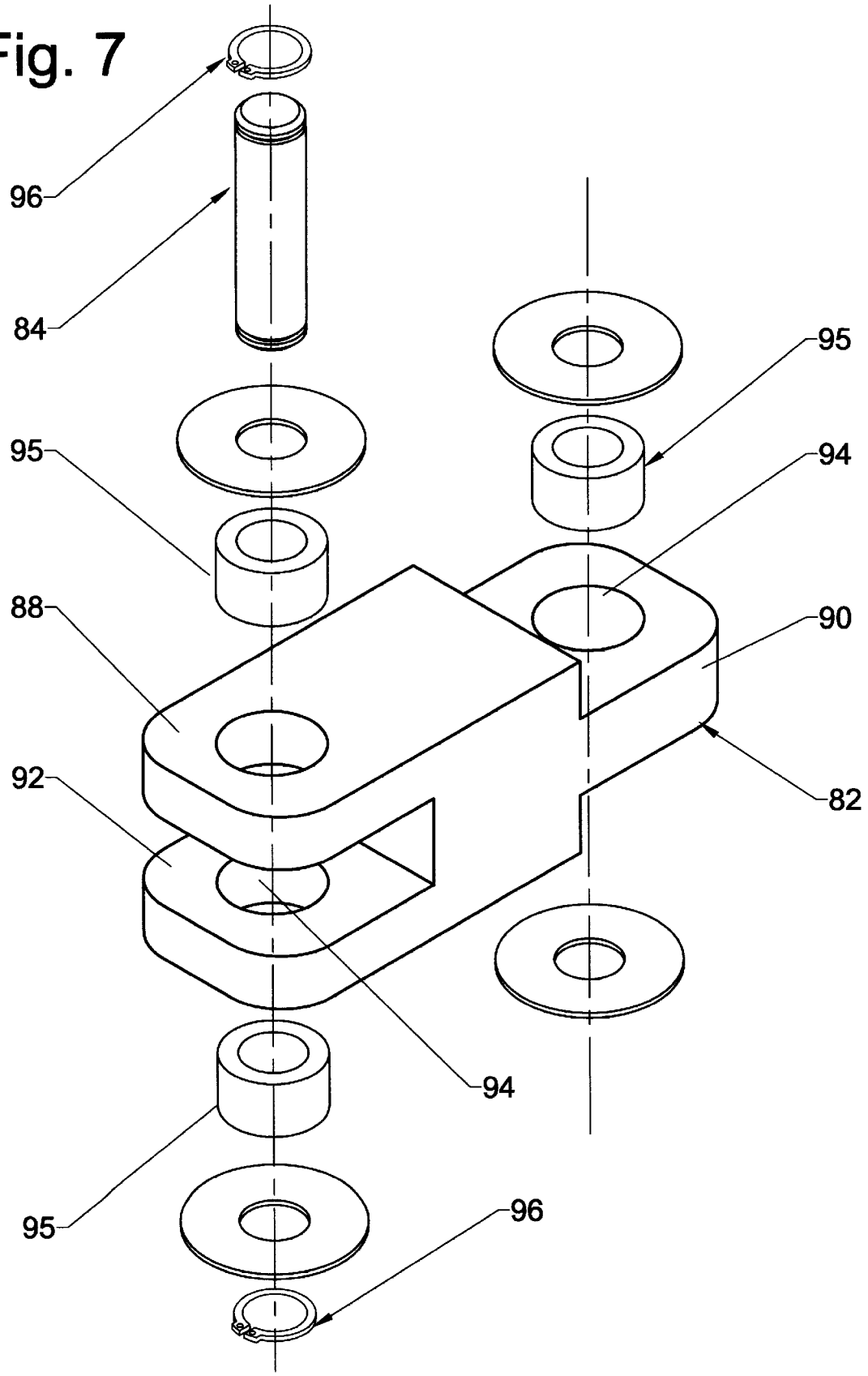
Figure 8A:
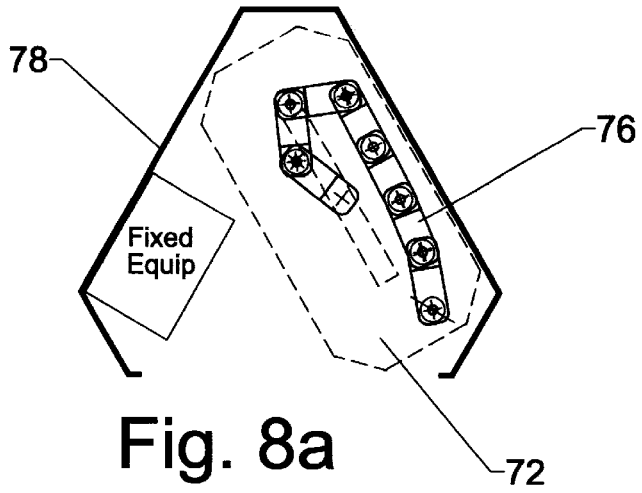
FIGS. 8*a* to 8*c* show various views of the device of FIGS. 6 and 7 located within the frame.

One embodiment of the flexible joint means 76 is shown in more detail in FIGS. 6 and 7. There comprises in this embodiment a chain 80 including a plurality of individual links 82 interconnected one to next by a pin 84 and retention means 86. FIG. 7 illustrates an individual link 82 comprising a machined link body 88, the body including a protrusion 90 and a recessed portion 92; the recessed portion 92 being adapted to receive the protrusion from an adjacent link. Apertures 94 are provided to receive the hinge pin 84; the apertures being separated from the hinge pin by a bronze wearing brush 95. As shown in FIG. 7, the hinge pin is held in place by a circlet 96 acting as the retention means. FIGS. 8*a, b, c* illustrate how the housing and base station are manipulated from a normal operating position (or stowed position) shown in FIG. 8*a* to a maintenance position or extended position illustrated in FIG. 8*b*.

Figure 8B:
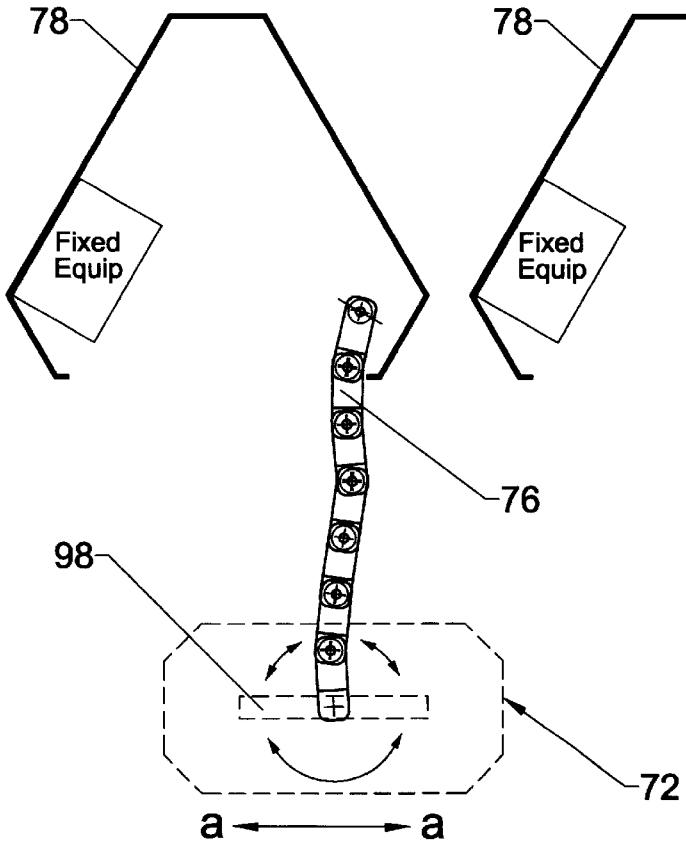
Figure 8C:
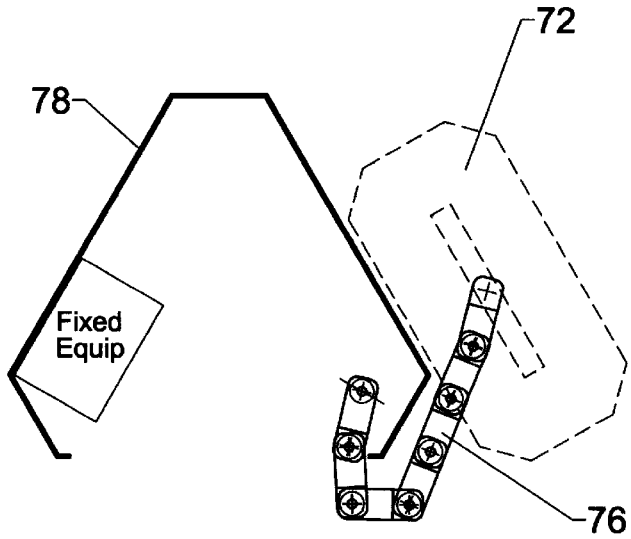

As shown in FIG. 8*b* the flexible joint means is connected to the housing by means of a slidable elongate joint 98 the housing can be moved in directions a—a. In this embodiment, the joint means 76 is also pivotally mounted to the housing thereby to rotate the housing to the desired maintenance position. This device advantageously allows the base station to be manipulated out of the way to enable access to other equipment if so desired, shown in FIG. 8*c*. It is envisaged that the device referred to above for moving a housing can be used for any large equipment stowed in a confined area and required to be movable to increase access without departing from the scope of the invention.

Figure 9A:
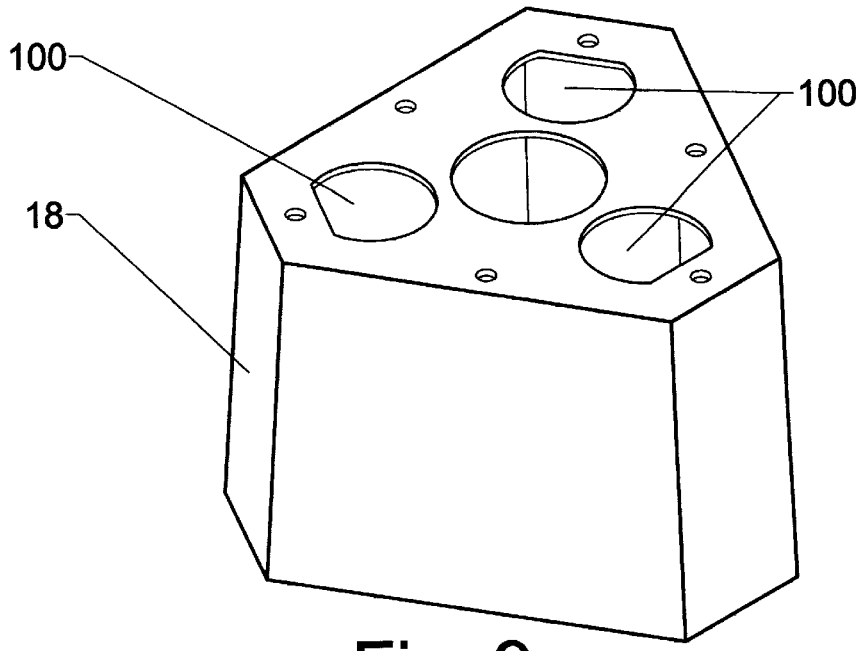
FIGS. 9*a* and 9*b* illustrate two embodiments of the intermediate module shown in FIG. 1.
Figure 9B:
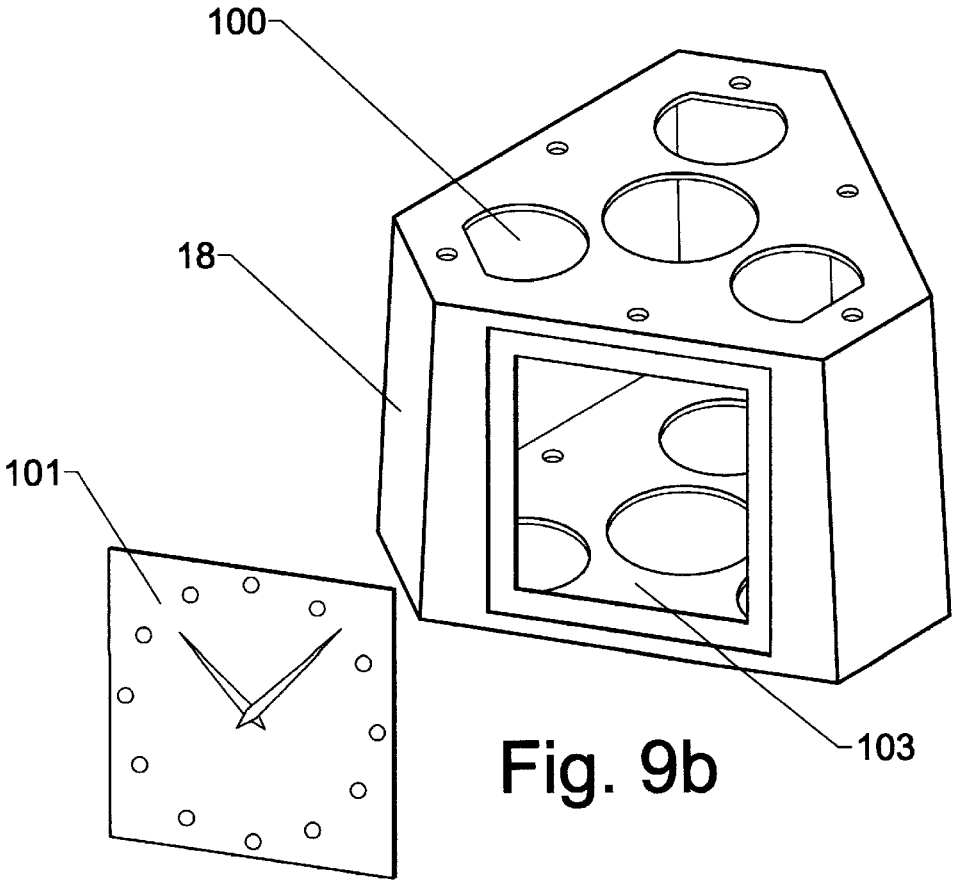

The middle module 16 and intermediate module 18 are substantially similar in construction and shape to the base and lower modules and as shown in FIGS. 1 and 2 taper inwardly from the bottom to the top of each module. An upper end of each of the middle and intermediate modules comprise four apertures 100 for receiving and supporting cabling which passes through the module. FIGS. 9*a* and 9*b* illustrate two embodiments of intermediate module 18 in which FIG. 9*a* illustrates a module substantially similar to the embodiment of FIG. 1. Optionally, the intermediate module 18 may comprise one or more clock faces 101 mounted to the module 18 and on one side there is an aperture 103 for receiving the or one of the clock faces shown in FIG. 9*b*, which is used to conceal the access panel to the clock mechanism and/or upper portion of the mast.

Figure 10:
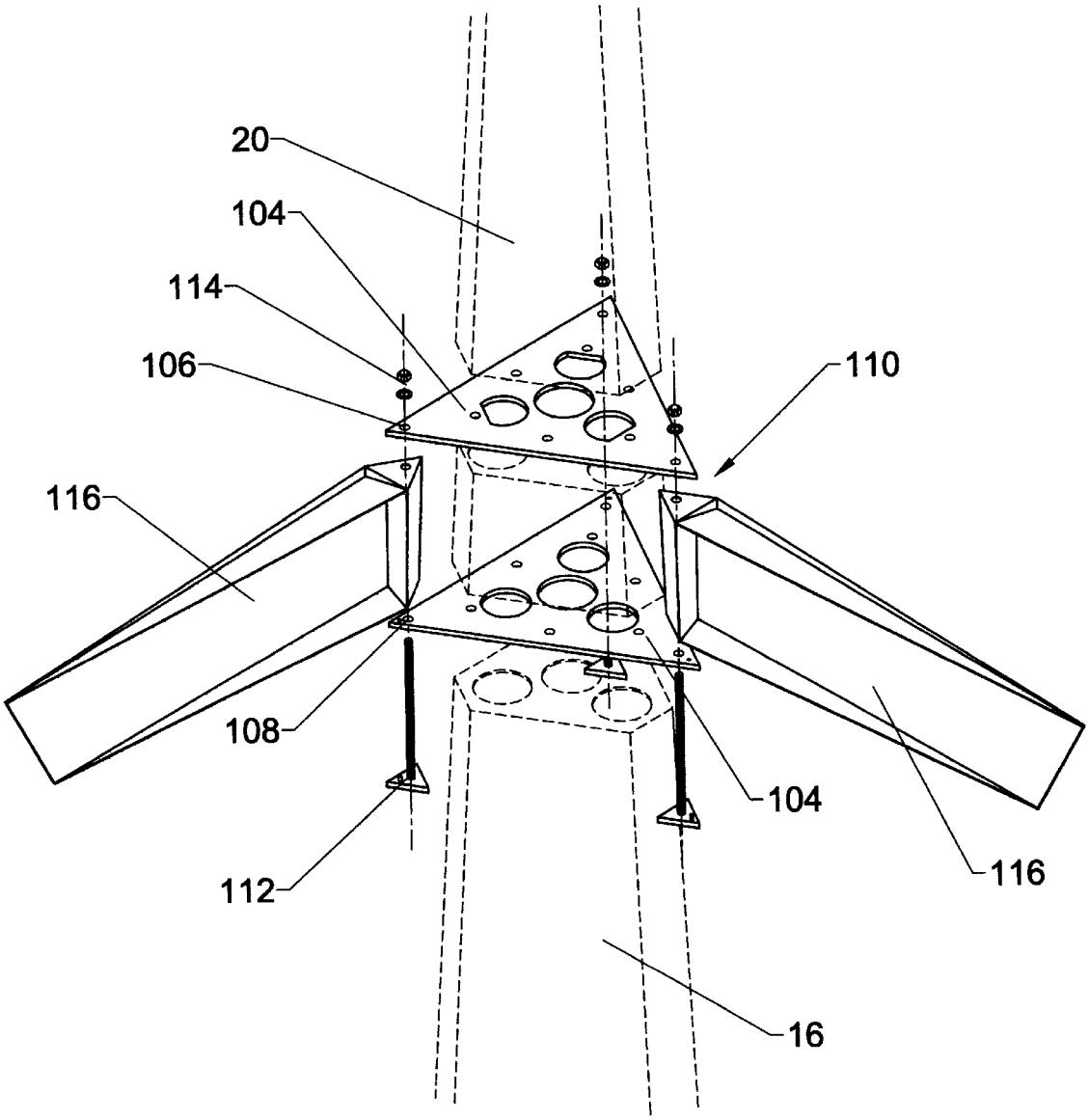
FIG. 10 is an exploded view of an upper portion of the mast shown in FIG. 1.
Figure 11:
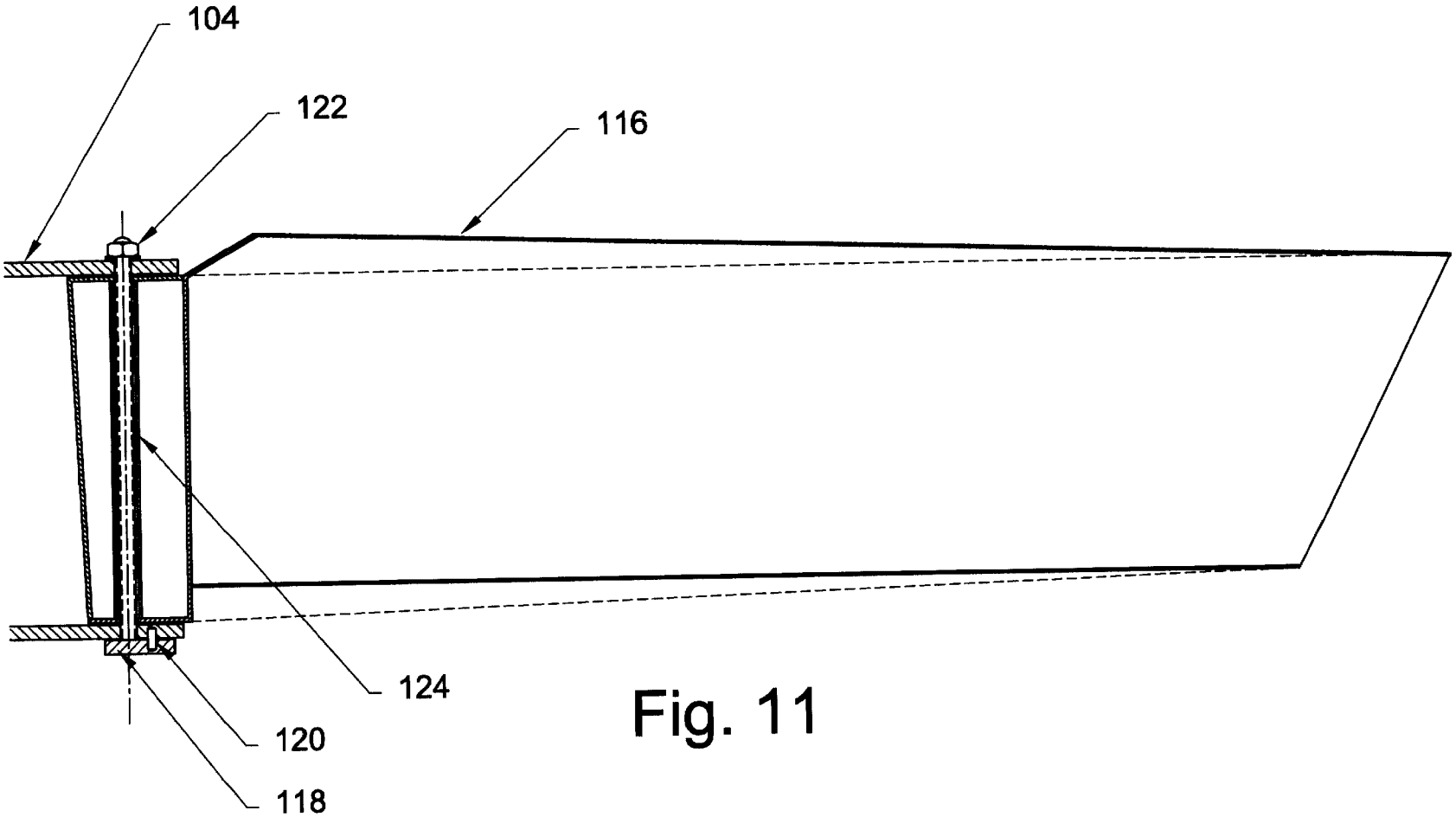
FIG. 11 is a side elevational view of the sign post arm.

As shown in FIG. 10, the intermediate module may be separated from the respective upper and middle modules 20, 16 by accessory plates 104 including protruding portions, which in this embodiment are triangular in shape. The protruding or corner portions of each accessory plate may comprise a pair of apertures 106, 108 are aligned and are adapted to receive and retain hinge means 110, for example a pin 112 and retaining means 114. A sign post arm 116 is connected to the hinge means 110 thereby to provide a sign post hingably connected to the mast. FIG. 11 illustrates a particular hinge means 110 including a tightening bolt 118 with a locating pin 120 held in place by a nut 122. The sign shown in FIG. 11 includes an internal reinforcing tube 124 for supporting the sign post arm.

In one class of embodiments, one or each accessory plate 104 may be adapted at their protruding portions to carry hanging baskets or the like by suitable securing means, known in the art. Further or alternatively, an optional plate 105 is mounted to the upper module, shown in FIG. 2 and flags, banners or the like can be connected to this plate 105 and one or more of the protruding portions of accessory plates 104.

Figure 12A:
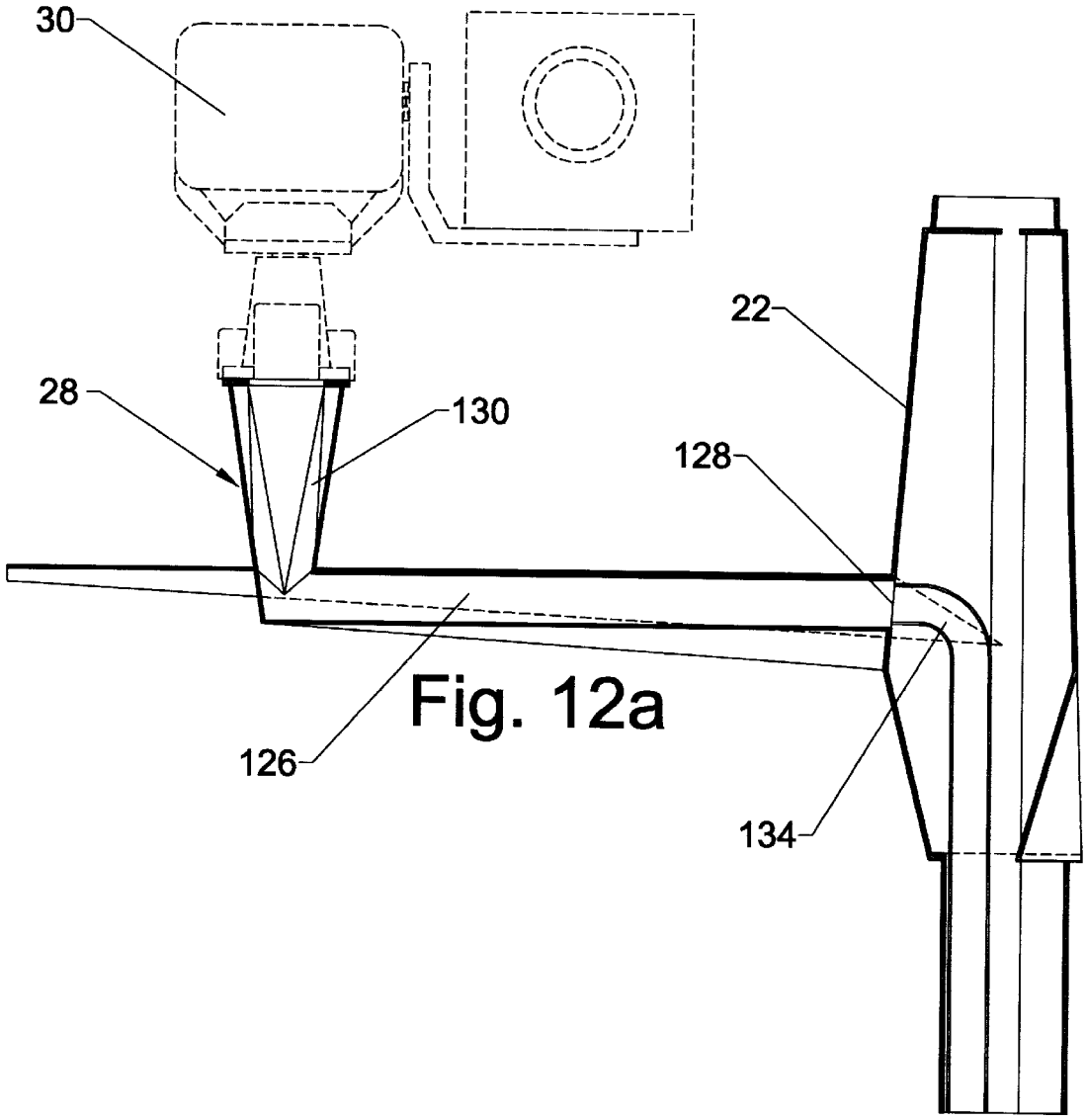
FIGS. 12*a* to 12*b* illustrate the camera support bracket part of the mast of FIG. 1.
Figure 12B:
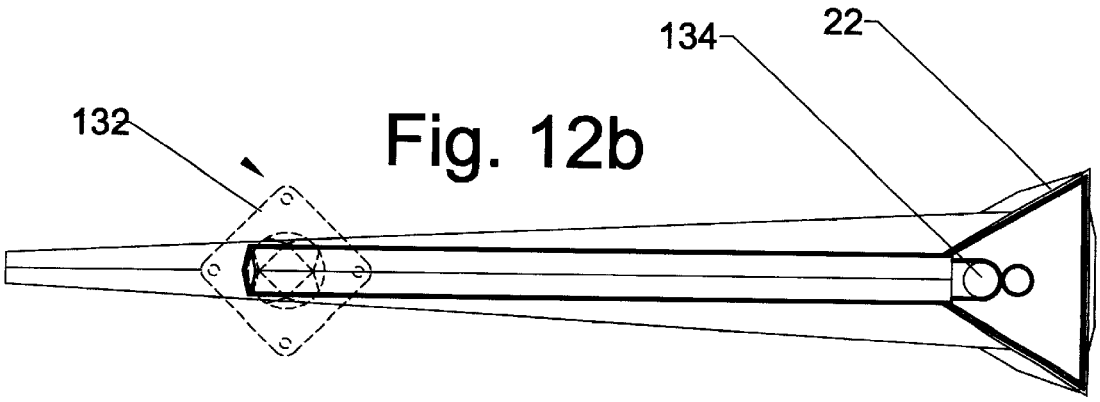

Turning again to FIG. 1 there is shown a camera support bracket 28 connected to the mast head 22. The support bracket is illustrated in more detail in FIG. 12*a* and comprises an elongate tubular section 126 extending outwardly in a substantially perpendicular plane to the mast 10 from an aperture 128 struck from the mast. The tubular section 126 includes an upstanding portion 130 and a plate 132 for receiving camera equipment 30, for example closed circuit television well known in the art. The cabling from the camera equipment passes through the tubular section 126 and the mast wall aperture 128. Optionally, there further comprises a curved tubular section 134 mounted within the mast head to guide the cabling in a downwards direction towards the base module 12. The provision of the aforementioned tube 134 results in a reduction in time spent connecting the camera equipment to a transmission line, for example an ISDN link in the base module.

In one class of embodiments, the mast head 22 is rotatable about the upper module 20 which is powered by suitable motor means, for example a servo motor to rotate the mast head, support bracket and camera equipment to enable the camera to rotate to another position about the mast.

Figure 13:
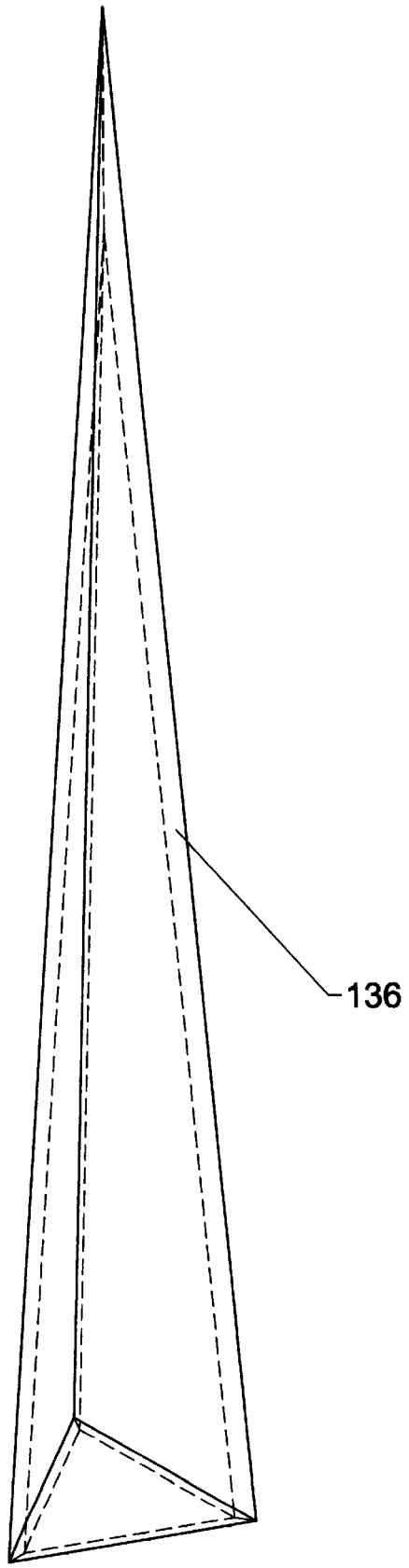
FIG. 13 illustrates an upper end of the mast of FIG. 1.

In this embodiment, the top of the mast comprises a light cone 136, shown in FIG. 13. It is preferably a pyramid shape and is formed from transparent or translucent material, preferably plastics material, for example perspex. The light cone 136 receives light from a light source 138 mounted in the base module 12 of the mast via an optic fiber cable. The shape of the cone allows for a substantially even emission of light through the cone. Suitable control means, for example photocell sensor, is mounted to the mast to detect nighttime conditions thereby to switch on the light source unit 138. Optionally, the light source unit 138 comprises a light source and a parabolic reflector to reflect the light to a point for transmission along the optic fiber cable.

Turning to the internal accommodation equipment in the base module and lower module shown in FIG. 14, there comprises a five way power distribution unit 140 and three way power distribution unit 142 mounted to the wall in the base module. The three way power unit 142 provides power to the camera control equipment 144 sited in the lower module and the camera and cellphone fiber gear 146. The five way power distribution unit 140 provides the power to a cooling fin and within the base module into the cellphone base transmitter station 148, the info point mini computer 150 and the light source unit 138. As shown in FIG. 14, an info point touch screen 152 is mounted in the lower module. The modules are capable of storing additional equipment, if so desired.

Figure 15:
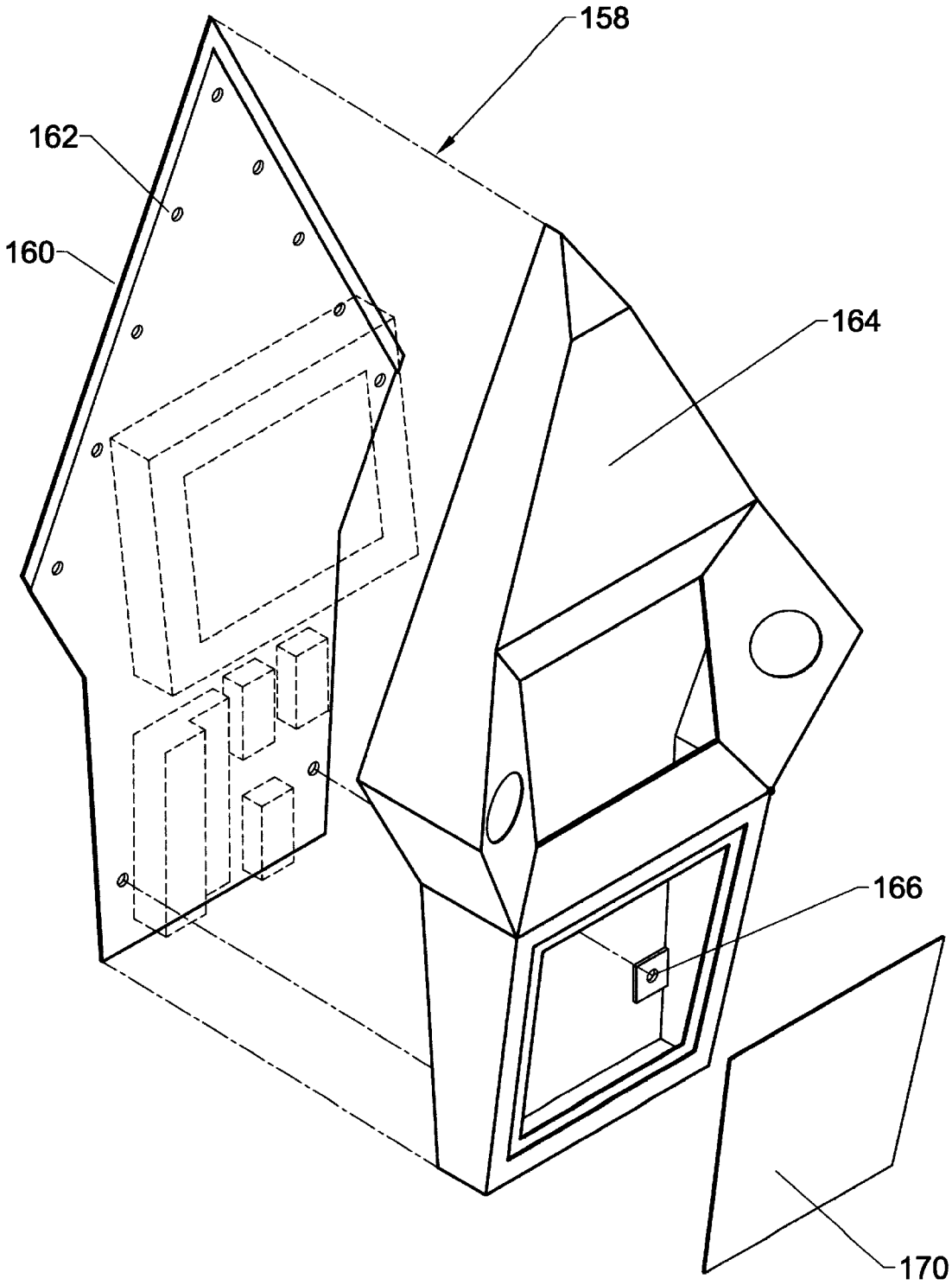
FIG. 15 illustrates a wall mounted console module according to another aspect of the invention.

In another class of embodiments, there further comprises a wall mounted console 158 FIG. 15 for supporting an information system, for example a visual display unit connected to a computer. As shown in FIG. 15, a wall mounting bracket 160 is provided with a series of fixing apertures 162 onto which is fixed a computer, a power supply and information point touch screen. The wall mount console frame 164 is connected to the bracket 160 and is secured thereto by suitable securing means connected to internal fixing points 166 mounted within an access area 168 thereby to prevent any unauthorized tampering. An access panel 170 is secured to the support frame 164 by suitable securing means.

It is envisaged that the present invention and its preferred embodiment can be fitted to suitable support means during construction of a new mast or as a module to be fitted to an existing mast of the present invention on a retro fit basis.

As recognized by those skilled in the art, the invention may be used or include further functions or be used in conjunction with other street furniture. Modifications may be incorporated without departing from the scope of the present invention as defined in the accompanying claims.

What is claimed is:

1. An apparatus for providing a multi-functional mast suitable for use with closed circuit television equipment comprising a plurality of tubular modular sections detachably connected together to define a tubular structure with two ends wherein a lower end is fixable to base support means and the structure tapers towards its upper end to provide a rigid structure and wherein the apparatus further comprises upper support means for supporting a camera at an upper portion of the tubular structure, said tubular modular sections being capable of being detached and replaced, and further wherein the tubular modular section adjacent the lower end contains a housing which is connected to an internal wall of the mast by a flexible joint means to move the housing from a stored position internal to the mast to an extended position external of the mast, the flexible joint means only being able to move in a plane perpendicular to the mast.

2. The apparatus as claimed in claim 1, further comprising a light source positioned in a lower tubular section, means to transmit light from the light source to the upper end of said structure thereby to be emitted from said upper end and control means to control the light emission.

3. The apparatus as claimed in claim 2, wherein the upper end is defined by a pyramidal section of transparent or translucent material adapted to receive and emit light from the light source.

4. The apparatus as claimed in claim 1, wherein the apparatus further comprises hinge means extending from a side portion of the mast and a sign hingably connected to said hinge means.

5. The apparatus of claim 1 wherein the tubular modular sections near the support means have six external faces with three faces being significantly larger than the other three faces, with the larger faces being capable of containing displays.

6. The apparatus as claimed in claim 5, wherein one of said larger faces of a tubular modular section comprises an aperture for receiving the display face of a visual display unit of a computer.

7. The apparatus as claimed in claim 5, further comprising a display panel struck from an external larger face of said apparatus which display panel includes frame and glazed panel for receiving and retaining advertising indicia.

8. The apparatus of claim 1 in which at least one of the tubular module sections removed in distance from the lower end has a plurality of apertures for receiving and supporting cables which pass through the module.

9. The apparatus of claim 1 in which the flexible joint means comprises a chain including individual links interconnected one to the next by a pin and retention means.

* * * * *